United States Patent [19]

Hilton

[11] 4,419,994

[45] Dec. 13, 1983

[54] RESPIRATORS

[75] Inventor: Joseph R. Hilton, Guildford, England

[73] Assignee: Racal Safety Limited, Middlesex, England

[21] Appl. No.: 276,163

[22] Filed: Jun. 22, 1981

Related U.S. Application Data

[63] Continuation-in-part of Ser. No. 134,661, Mar. 27, 1980, abandoned.

[30] Foreign Application Priority Data

Jul. 3, 1980 [GB] United Kingdom ..... 8021880

[51] Int. Cl.[3] ..... A62B 7/00

[52] U.S. Cl. ..... 128/206.19; 128/206.12; 128/206.16; D29/8

[58] Field of Search ..... 128/206.19, 206.12, 128/206.16, 139, 206.24, 206.28, 909; D29/8; 46/1 F; 32/1 R; 2/9, 175, 206

[56] References Cited

U.S. PATENT DOCUMENTS

| | | | |
|---|---|---|---|
| Re. 29,613 | 4/1978 | Kropfhammer | 128/909 |
| 1,292,096 | 1/1919 | Schwartz | 128/202.16 |
| 1,523,884 | 1/1925 | Leduc | 128/139 |
| 1,868,281 | 7/1932 | Falkson | 2/175 |
| 3,971,369 | 7/1976 | Aspelin et al. | 128/206.19 |
| 4,248,220 | 2/1981 | White | 128/206.19 |

FOREIGN PATENT DOCUMENTS

| | | | |
|---|---|---|---|
| 1778 | 7/1900 | Fed. Rep. of Germany | 2/175 |
| 1298420 | 6/1969 | Fed. Rep. of Germany | 128/206.19 |
| 1220851 | 5/1960 | France | 128/139 |
| 7706660 | 12/1977 | Netherlands | 128/206.19 |
| 4787 | of 1912 | United Kingdom | 128/206.19 |

*Primary Examiner*—Henry J. Recla

*Attorney, Agent, or Firm*—Laubscher, Philpitt & Laubscher

[57] ABSTRACT

The present invention relates to a respirator of the type called a filtering facepiece which is made from a flat pocket of flexible filtering sheet material having a generally tapering shape with an open edge at the larger end of the pocket and a closed end at the smaller end of the pocket. The closed end of the pocket is formed with fold lines defining a generally quadrilateral surface comprising triangular surfaces which are folded to extend inwardly of the pocket, the triangular surfaces facing each other and being, in use, relatively inclined to each other.

13 Claims, 31 Drawing Figures

RESPIRATORS

This application is a continuation-in-part of Ser. No. 134,661, filed Mar. 27, 1980, abandoned.

BRIEF DESCRIPTION OF THE PRIOR ART

The present invention relates to improvements in respirators and particularly to filtering face pieces.

Filtering face pieces have been known for many years, originally in the form of simple surgical masks giving a degree of protection to a patient from germs contained in a doctor's or nurse's breath. Such masks are normally of simple, usually pleated, construction and are held on the face covering the nose and mouth by tapes or rubber bands. These masks give a degree of filtration and protection to no specified level. In recent years filtering face pieces have been introduced into industry, and these industrial face pieces offer a degree of protection to the wearer hitherto not obtainable. This has been made possible by the appearance on the market of new filtration materials, together with improved methods of manufacture which in many cases are automated resulting in high volume production at low cost. Such filtering face pieces are generally of one of two types, being either a moulded cup or a pleated sheet material mask. In the moulded cup, either the filtration material is sandwiched between two low resistance fibrous moulded cups forming an inner and an outer layer which are joined together at the open mouth of the cup normally by welding or adhesive, or the filtration material is moulded to form the cup. One or two light rubber bands are attached to the edge of the open mouth of the cup and usually a small deformable metal nose piece is provided to give better sealing around the nose. The second type of filtering face piece is made from a flat sheet of filtering material which is folded in the shape of a flat pocket with an open edge and provided with a number of transverse pleats, one or two head bands being attached to the open edge of the pocket. The purpose of the pleats is to increase the filtration area and thus decrease face velocity through the material and hence reduce the inhalation and exhalation resistance and improve the efficiency of the filtration material.

There are now appearing on the market improved filtration materials of increased performance giving higher efficiencies, i.e. lower penetrations, combined with reduced pressure drop thus making it unnecessary to increase the filtration area by providing pleats. This means that a lighter, less cumbersome face piece can be provided having in some cases greater flexibility. Whereas the previous filtration materials worked generally on the interception principle, being composed of fibres, typically cellulose fibres, with added short glass fibres, or of glass fibres made up into paper, or felt-like materials of varying degrees of efficiency, the new generation materials comprise micro-fibres having both an electrostatic and mechanical efficiency. These micro-fibres are normally contained within two sheets, known as scrim sheets, which are of very low resistance and normally play no part in the filtration action; they are there merely to protect and hold the micro-fibres together. The micro-fibres are composed typically of p.v.c. or polycarbonate. There is also on the market an electret type of material of similar action.

The design of a face piece to take advantage of the increased efficiency of these new materials thus poses new problems. Since the filtration material is relatively expensive, economy of material is a prime factor. Fortunately, the compensating advantage is that less material is needed and it is therefore an object to use as little material as possible consistent with strength and wearability. The very simplest face pieces, consisting of little more than a flat pocket of material which pocket is opened out to fit over the face of the wearer, suffers from several disadvantages not least of which is a tendency to collapse onto the face of the wearer, during inhalation, which can be uncomfortable when the respirator is worn for a considerable length of time and which makes speech difficult. Also such simple face pieces tend to suffer from face seal leakage, i.e. leakage around the mouth of the respirator pocket between the edge of the mouth and the face. It will be appreciated that high face seal leakage reduces the efficacy of the face piece.

SUMMARY OF THE INVENTION

According to the present invention there is provided a filtering facepiece formed from flexible filtering sheet material in the form of a flat pocket of generally tapering shape having opposed side walls, an open edge at the larger end of the pocket and being closed at the smaller end of the pocket, wherein the closed end of the pocket is provided with first fold lines defining a generally quadrilateral surface comprising a plurality of triangular surfaces having edges in common which are folded to extend inwardly toward said larger end of said pocket, said triangular surfaces facing one another and being, in use, relatively inclined to each other.

Preferably the common edges of the triangular surfaces are defined by a second fold line which is longitudinally rigidified to act as a strengthening rib. The first fold lines may also be longitudinally rigidified.

Preferably the flexible filtering sheet material is weldable, the first and second fold lines being defined by welds made in the material which have the effect of longitudinally rigidifying the fold lines.

The open edge of the pocket may be provided with an inwardly directed sealing strip as described in U.K. patent specification No. 2,045,083.

According to another aspect of the present invention there is provided a filtering face piece made from flexible filtering sheet material in the form of a flat pocket having the general shape of a section of a frusto-cone and having opposed side walls, an open edge at the larger end of the pocket and a closed end at the smaller end of the pocket, wherein said closed end of said pocket is provided with first fold lines defining a generally quadrilateral surface composed of two triangular surfaces, said triangles of which have a common base, the apices of said triangles opposite said common base lying on the edge of said pocket defining said closed end of said pocket, and said common base extending in a direction perpendicular to said closed end edge, said triangular surfaces facing each other and being, in use, relatively inclined to each other.

BRIEF DESCRIPTION OF THE DRAWINGS

The present invention will be more fully understood from the following description of embodiments thereof, given by way of example only, with reference to the accompanying drawings.

In the drawings.

DETAILED DESCRIPTION

Figure 5:
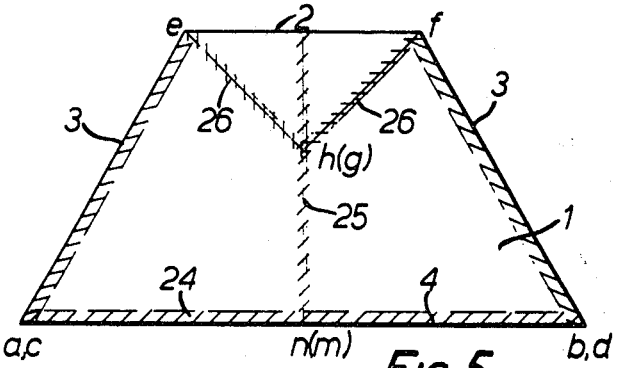
FIGS. 5 to 9 show stages in the production of a filtering face piece from the blank of FIG. 3.
Figure 13:
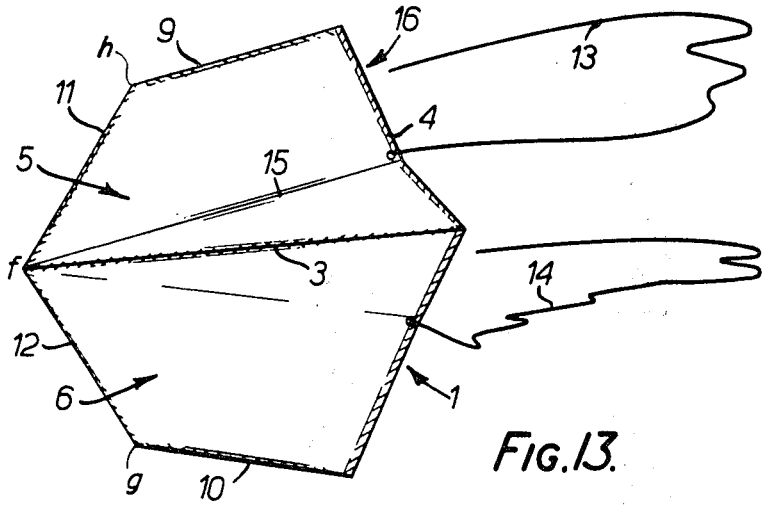
FIG. 13 is a side view of the filtering face piece in an open condition.
Figure 14:
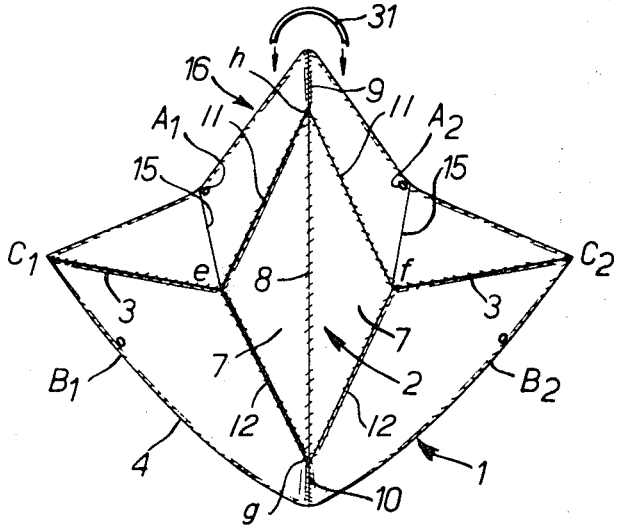
FIG. 14 is a front view of the filtering face piece of FIG. 13 again in an open condition.
Figure 15:
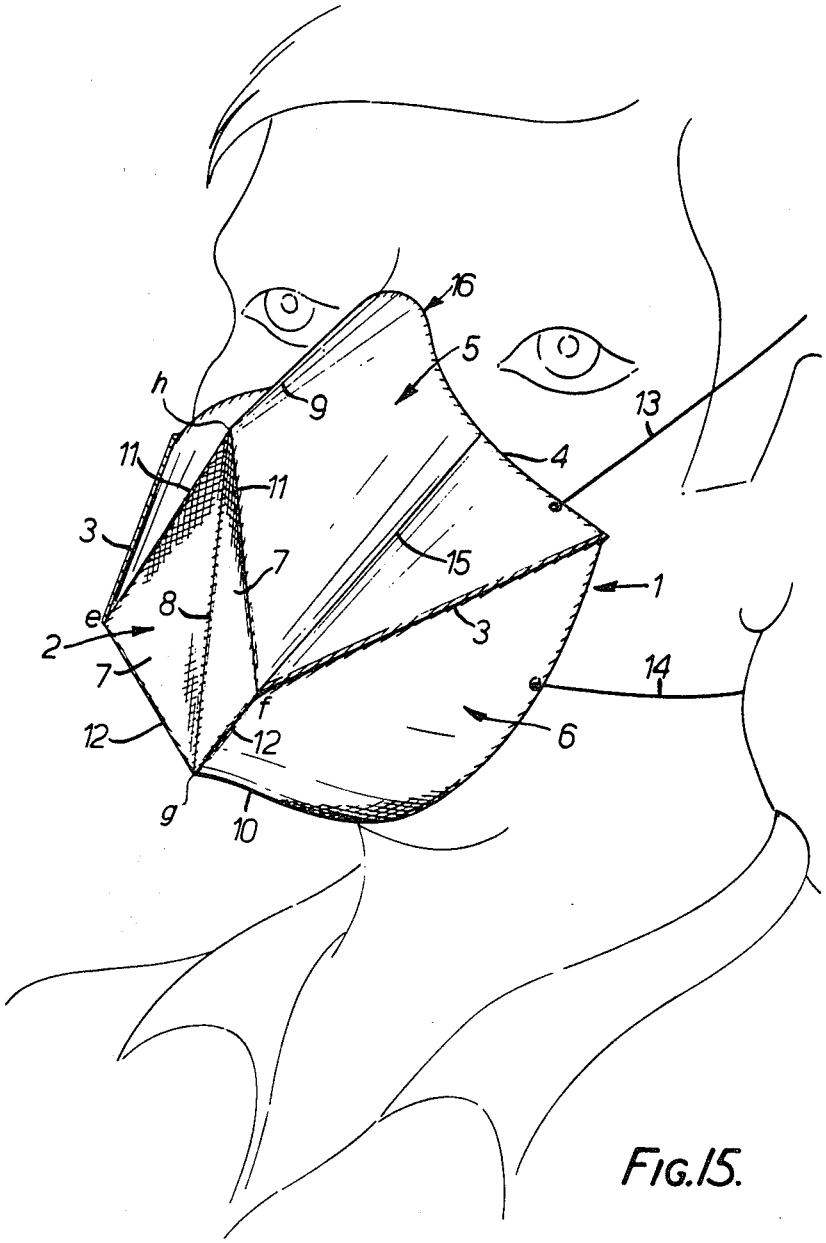
FIG. 15 is a perspective view of the filtering face piece of FIGS. 13 and 14 in use.
Figure 17D:
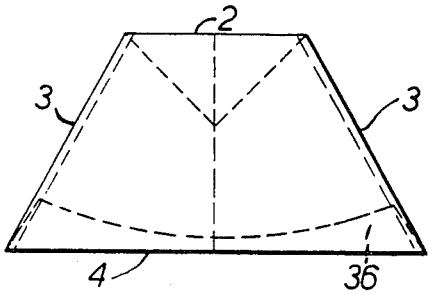
FIGS. 17(*a*) to (*e*) show various stages in the production of a modification of the face piece of FIGS. 13 to 15.
Figure 17E:
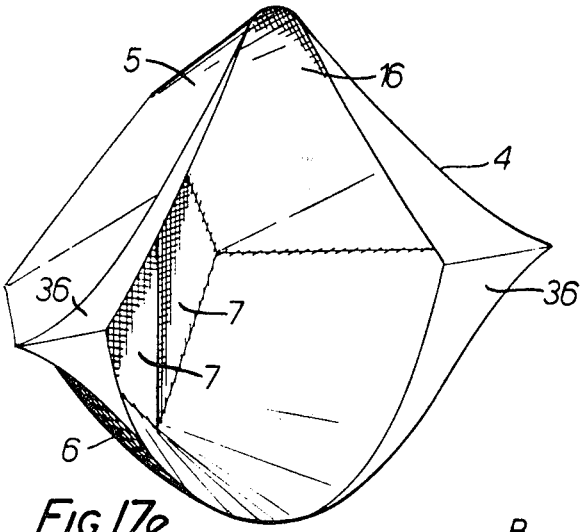

The facepiece shown in FIGS. 13 to 15 is made from flexible filtering sheet material, for example, as described above, which is initially in the form of a flat pocket 1, as shown in FIG. 5, having the general shape of a section of a frusto-cone with a closed end 2 along the smaller end, closed lateral edges 3 and an open edge 4 at the larger end. For convenience hereafter, the pocket 1 will be described as having an upper wall 5 which in use overlies the nose of the wearer and a lower wall 6 which in use underlies the chin of the wearer.

This flat pocket 1 is folded as will be described hereafter to create at the closed end of the pocket a quadrilateral surface comprising two substantially identical triangular surfaces 7, the triangles of which have a common base 8 and apices e, f opposite the base 8 which in this embodiment lie at the corners or ends of the closed end 2 of the flat pocket. The common base 8 lies on a line perpendicular to the line joining apices e, f and the triangular surfaces 7 face each other and are, in use, inclined to each other.

Advantageously the fold line defining the common base 8 of the triangular surfaces 7 is extended by fold lines 9 and 10 (FIG. 14) on each wall of the pocket that extend from the ends of the base fold line 8 to the open edge 4 of the pocket.

In addition to the above fold lines, the facepiece advantageously has fold lines 15 extending from the lateral extremities of the quadrilateral surface, i.e. apices e, f, on the upper wall 5 of the pocket to points on the edge 4 intermediate the fold line 9 and the lateral edges 3. These fold lines 15 together with fold line 9 define in the upper wall 5 an inverted V-shaped channel 16 which seats on the nose of the wearer and thus positively adapts the upper wall 5 of the pocket to the shape of the wearer's face so as to decrease edge seal leakage around the nose and in the area between the nose and the cheeks.

The face piece is held on the face by one or, as shown, two head bands 13, 14 attached to the pocket adjacent the edge 4. The head bands may be attached at points A1, A2 and B1, B2, or both may be attached at C1, C2 at the ends of the lateral edges 3, or a single band may be attached at points C1, C2.

Figure 1:
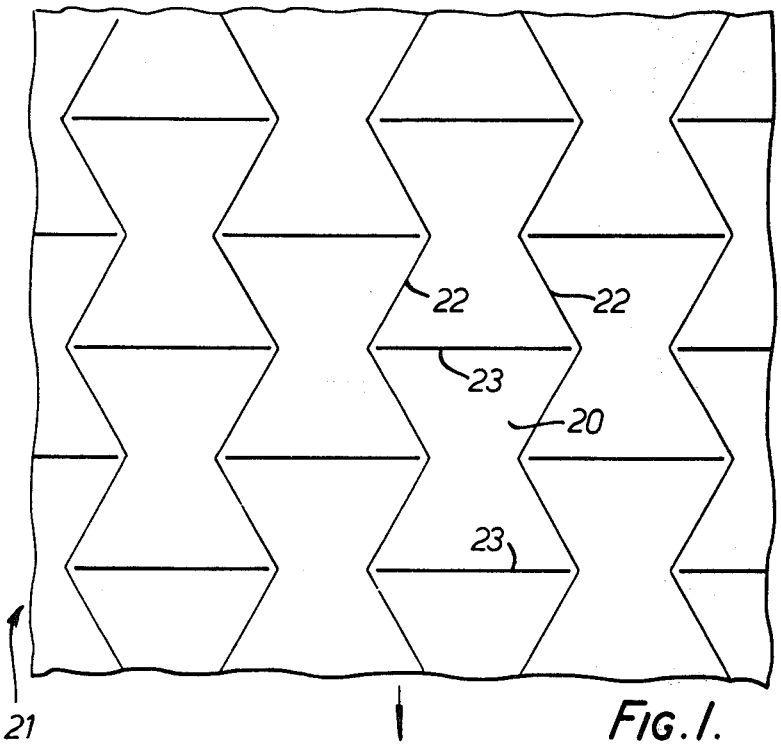
FIG. 1 is a plan view of a sheet of filtering material showing the manner in which the blanks for an embodiment of a filtering face piece according to the present invention can be cut therefrom.
Figure 3:
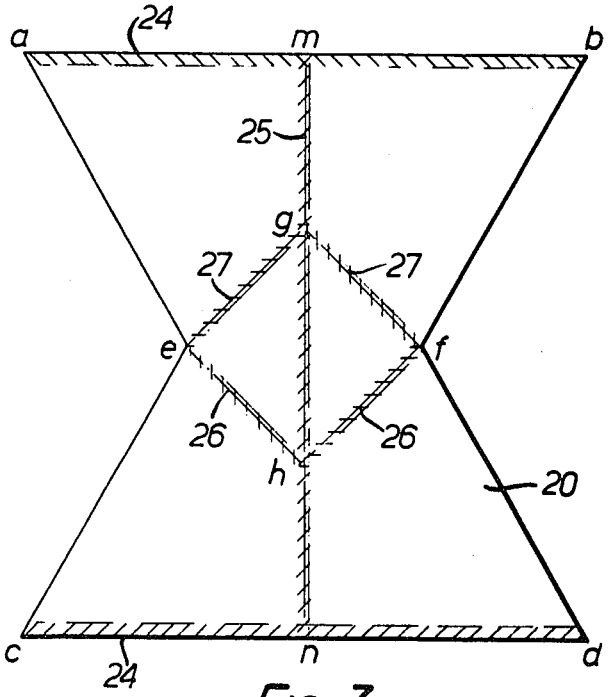
FIG. 3 is a plan view of a blank for an embodiment of a filtering face piece according to the present invention.

The production of a face piece as described above will now be described initially in connection with filtering sheet material which is weldable, e.g. by high-frequency welding, ultrasonic welding or heat welding. The face piece is made from a blank 20 as shown in FIG. 3 which is composed of two parts each having the shape of a section of a frusto-cone and arranged with the smaller ends together to have an hourglass configuration. This blank shape has advantages from the point of view of economy of manufacture from a sheet 21, FIG. 1, of the material which is substantially wider than the blank, e.g. 3 m wide by approximately 100 m long. It will be seen from FIG. 1 that a plurality of blanks can be cut out of the sheet 21 on a continuous basis, the blanks being arranged in longitudinal rows, with the blanks on one row being off-set longitudinally by a half blank length relative to the blanks in an adjacent row. The only wastage of sheet material then occurs at the two edges of the sheet. The blank may, for example, be 21 cm wide at the wider end ab, cd of each frusto-cone section, 9.5 cm wide at the smaller end ef of each frusto-cone section and approximately 19 cm long so that the angle of the cone is approx 59°.

Figure 2:
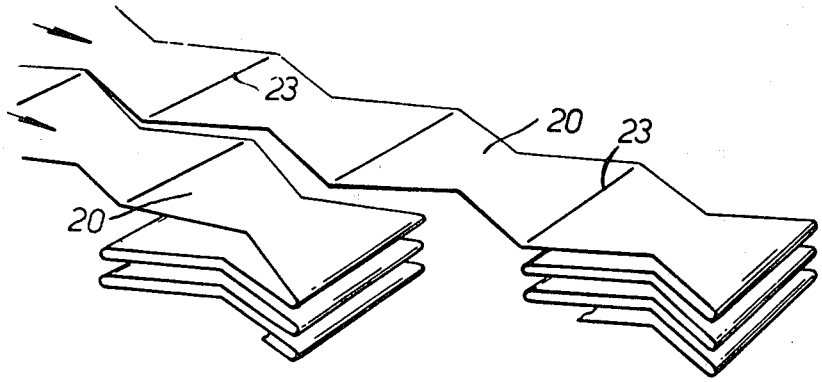
FIG. 2 is a perspective view of the cut blanks of FIG. 1 at the end of the cutting operation.

A sheet 21 of filtration material is passed through a high speed cutting machine on a continuous basis, the machine making continuous longitudinal zig-zag cuts 22 defining the lateral side edges of the blanks and possibly also making transverse cuts 23 defining the ends of the blanks. These cuts 23 do not extend the full width of each row of blanks to ensure that the rows of blanks remain connected together for convenience of subsequent processing. At the end of the cutting machine the row of blanks are folded in zig-zag fashion as shown in FIG. 2.

The next operation, which may be combined with the cutting operation, or only with the production of the cuts 23, is to impress upon each blank a pattern of welds as shown in FIG. 3. These welds comprise sealing welds 24 along the end edges of the blank to prevent fraying of the material along these edges, a central longitudinal weld 25 which defines the fold lines 8, 9 and 10 and four welds 26, 27 which define the fold lines 11, 12.

The whole weld pattern may be impressed in a single operation or may be built up from a number of straight line welds.

Figure 4A:
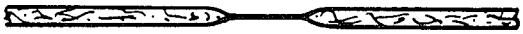
FIGS. 4(*a*) and (*b*) are diagrammatic sectional views showing welds which can be used in the manufacture of the filtering face piece.
Figure 4B:
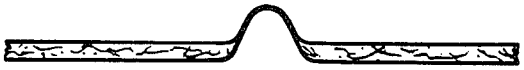

The effect of these welds is as shown in FIG. 4(*a*) to compress and flatten the material in the region of the weld, and it is found that this does provide a degree of longitudinal rigidity to the welded line. It is possible, by use of suitably shaped electrodes or by a subsequent heating operation, to profile such a weld, e.g. as shown in FIG. 4(*b*), so as to increase the longitudinal rigidity of the weld. This profiling may be effected in relation to the part of the weld 25 defining the common base 8 of the triangular surfaces 7, at least.

Figure 6:
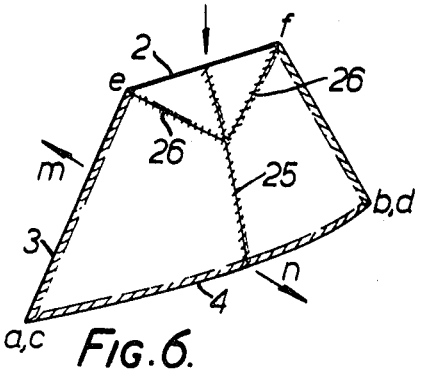
Figure 7:
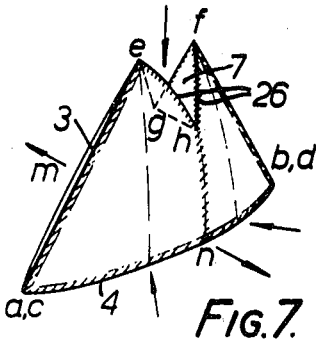
Figure 8:
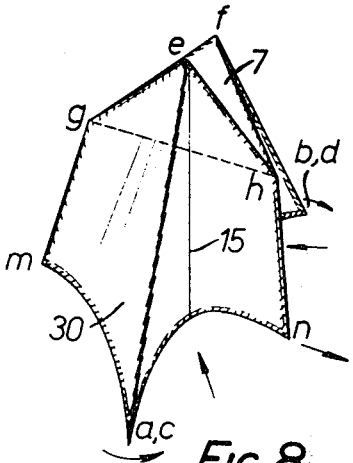
Figure 9:
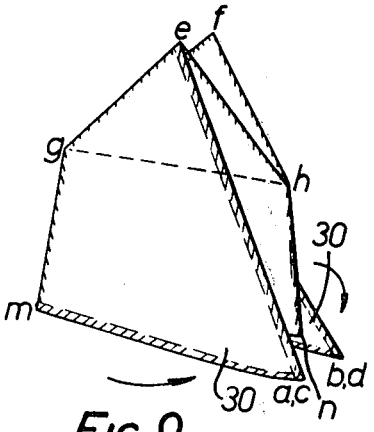

After this operation, the blank is folded in half as shown in FIG. 5 to superimpose the two frusto-cone section parts which eventually form the upper and lower walls 5, 6 of the face piece pocket, and to form the closed end edge 2. When in this folded condition, the lateral edges 3 of the walls 5, 6 are welded together to create the flat pocket, of which the open edge 4 is formed by the welded edges 24. In the next operation, shown in FIG. 6, the pocket is opened by pulling on the ends n, m of the central weld 25, and at the same time the centre point of weld 25 is depressed to fold the blank along the welds 25, 26 and 27 and create the triangular surfaces 7, as shown in FIG. 7. Further separation of the points n and m brings the triangular surfaces 7 together, as shown in FIG. 8. This produces triangular wings 30 which are then folded towards the point n to lie flat against the remainder of the pocket, as shown in FIG. 9. This operation creates the fold lines 15 extending from the apices e, f to the open edge 4 of the pocket. These fold lines 15 may however have been predefined by making appropriate welds in the original blank, simultaneously with the production of welds 24 to 27.

The face piece as shown in FIG. 9 is completely formed except for the attachment of head bands to points previously described.

Figure 10:
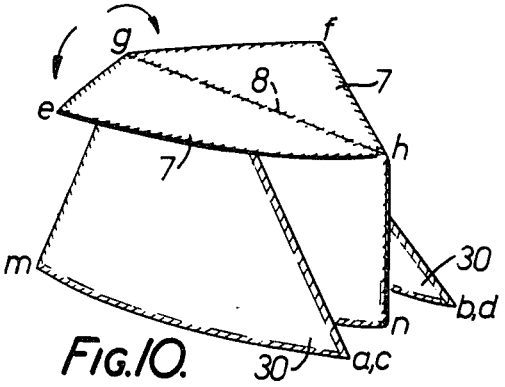
FIGS. 10 to 12 show additional stages in the production of a filtering face piece.
Figure 11:
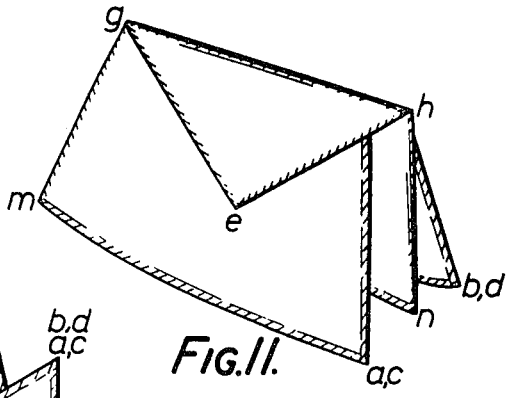
Figure 12:
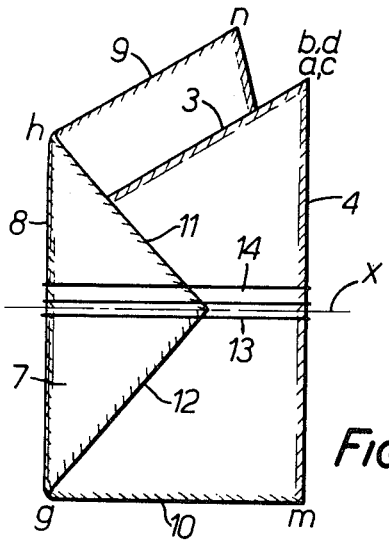

A further folding operation may be performed, as shown in FIGS. 10 to 12. As shown the triangular surfaces 7 are separated and folded downwardly in opposite directions about fold line 8 until they lie against the rest of the pocket, as shown in FIG. 11. This creates a generally rectangular flat pack which can easily be slipped into the pocket of the wearer, possibly inside an envelope. The head bands can be wound round the pack, as shown in FIG. 12.

A small deformable metal strip 31 (FIG. 14) may be attached to the upper wall 5 of the face piece so as to extend over the apex of channel 16 adjacent edge 4 for improving sealing across the bridge of the nose.

To use the face piece it is restored to the condition shown in FIG. 9 and is then opened by pulling apart the ends of the lateral edges 3 which results in the face piece having the form in FIGS. 13 and 14.

It will be appreciated that the shape of the above described face piece is inherently advantageous in two important respects.

The shaping of the upper wall 5 of the face piece with the channel 16 predisposes the face piece to nestle into the difficult-to-seal areas to either side of the nose. Additionally, the strip 31 is predeformed into a U-shape, by the folding up of the face piece, and is thus ready for clipping over the nose of the wearer when the wearer places the face piece on his face. No conscious action is required on the part of the wearer to deform the strip, although conscious action may be required to relieve the shape of the strip until it fits comfortably onto the nose.

While the face piece described above is described as being made from weldable material so that the fold lines 8, 9, 10, 11 and 12 can be defined by welds, it will be appreciated that, whether or not the material is weldable, these fold lines may be defined by other means or may simply be defined by preformed crease lines. Some or all of these fold lines may be reinforced, the reinforcement being created by applying strengthening elements along the fold lines, for example by applying strips of synthetic plastic material, e.g. by injection moulding or otherwise, along the fold lines, the strips of plastics being profiled or not as required and/or holding the material in a folded condition.

Other filtering materials which could be used for the face piece include, for example, charcoal cloth arranged between two scrim sheets, forming a respirator having gas and vapour filtering capabilities. The charcoal cloth is activated charcoal in the form of a cloth made initially of a woven synthetic fibre, e.g. rayon. Charcoal impregnated filtering materials may also be used. Alternatively the charcoal cloth or charcoal impregnated filtering material may be combined with one or more layers of particulate filtering material to provide a respirator having particulate as well as gas and vapour filtering capabilities.

The overall shape of the finished face piece, and consequently the degree of fit, is dictated by the dimensions of the original blank shown in FIG. 3 and by the dimensions of the quadrilateral area comprising the triangles 7. If this quadrilateral area is a square or a rhombus, the resulting face piece is symmetrical about a centre line extending parallel to the line X in FIG. 12. By making the lengths of the fold lines 11 and 12 unequal some variation in the shape of the face piece is possible. For example, lines 11 can be made longer than lines 12, i.e. the line joining apices e, f (FIG. 3) is made shorter than the line joining apices g, h and these lines do not cross at their centre points. The resulting shape may be described as an upside-down kite and this leads to the face piece having a side view as shown in FIG. 12 in which the fold line 12 is parallel to the centre line X and the fold line 9 is at an angle of approximately 25° to the centre line X. This is a close approximation to the classic orinasal cup shape.

In one embodiment, the length of the line joining the apices e, f is 8 cm, the length of the line joining the apices g, h is 10 cm and the lines intersect at a point which is 4 cm from apex h and 6 cm from apex g so that the angle between welds 25 and 26 is 45° and that between weld 25 and 27 is 33.7°.

For convenience of manufacture however, the quadrilateral area may be made square with the lines joining apices g, h and e, f both having a length of 9.5 cm, and intersecting at their mid points.

Figure 16:
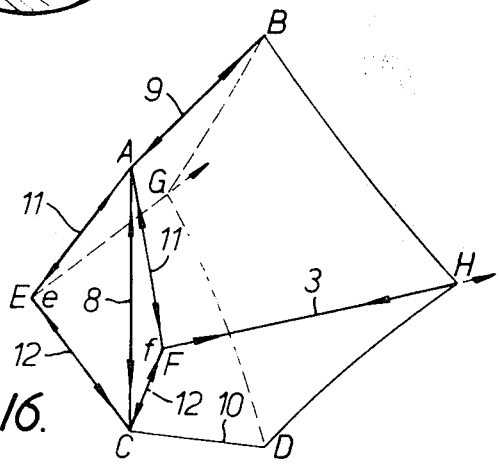
FIG. 16 is a diagrammatic view showing the operation of the filtering face piece of FIGS. 13 to 15.
Figure 17A:
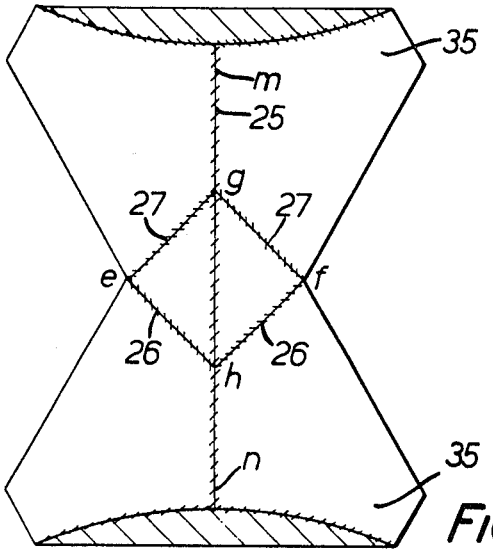
Figure 17B:
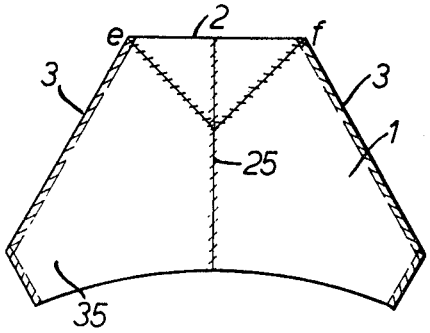
Figure 17C:
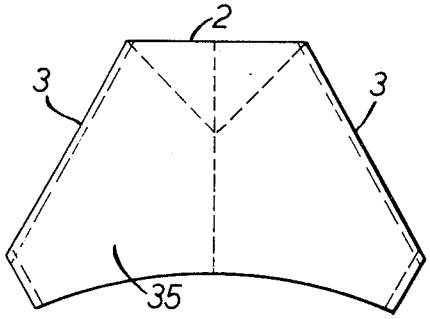

Referring to FIG. 16 it can be seen that the completed facepiece can be regarded as comprising a frame defined by the fold lines 8, 9, 10, 11 and 12 between which the filtration material extends. The folds 8, 9, 10, 11 and 12 can be likened to struts in compression which are pin jointed at their ends A, C, E, F. The welds along the lateral edges 3 are under tension during exhalation and may be under compression during inhalation and therefore rigidity in compression is desirable. The strut formed by fold line 8 is particularly important since this lends stiffness to the facepiece in a vertical position. The effective pin joints E, F at the apices e, f can thus radius around the strut 8 giving a degree of flexibility and mobility to the facepiece, which can thus easily adapt to fat or thin faces. When the jaw of the wearer is moving, as for example in speaking, the apices e, f move in space thus relieving the load which would otherwise occur on the bridge of the nose causing the facepiece to fall off. Furthermore, the reinforcing of the facepiece provided by the fold lines 8 to 12 effectively prevents the facepiece collapsing on the face of the wearer even when becoming clogged and therefore inefficient.

Figure 24:
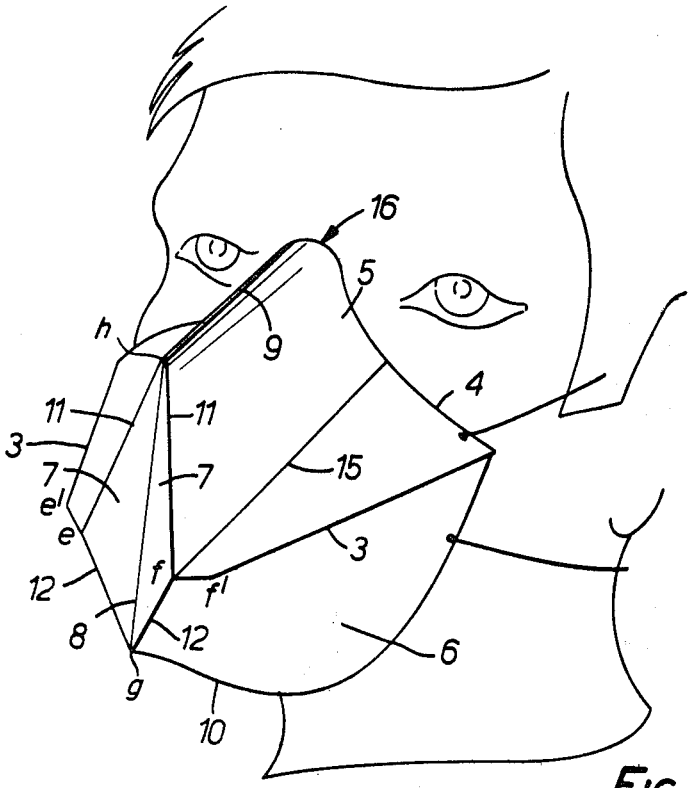
FIG. 24 is a perspective view of another embodiment of filtering facepiece according to the present invention.
Figure 25:
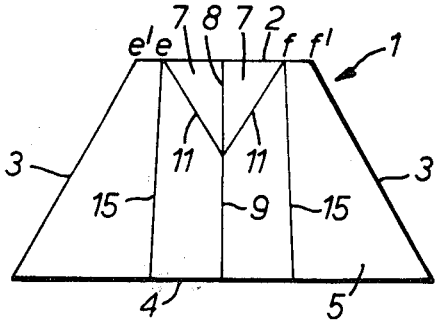
FIG. 25 is a plan view of a flat pocket used to make the facepiece of FIG. 24.

Another embodiment of a filtering facepiece is shown in FIGS. 24 and 25, and corresponds exactly with that of FIGS. 1 to 17 (like reference numerals having been used for like parts), except that the apices e, f of the triangular surfaces 7 opposite the common base 8 lie inwardly of the corners e', f' of the closed end 2 of the flat pocket 1.

Apart from this difference in the positioning of the apices e, f, relative to the corners e', f', the facepiece otherwise has all the features of the facepieces described above.

When the facepiece is in use, the portions of the closed end of the pocket respectively between the apices e, f and the corners e', f' of the closed end do not lie on a straight line as in the flat pocket but become mutually inclined so that the closed end of the pocket has a generally frusto-conical shape which improves the fit of the facepiece to the wearer's face.

A modification of the facepieces described above is shown in FIG. 26 in the context of the embodiment of FIGS. 24 and 25. In this modification, the flat pocket from which the facepiece is made has a slightly different shape from that of FIGS. 5 and 25 in that it comprises two frusto-conical section portions, a first portion providing the open end of the pocket, and a second portion providing the closed end of the pocket which has a larger cone angle than that of the first portion. Preferably the cone angle of the frusto-cone of the first portion is approximately 60°. It will be appreciated that the precise shaping of the flat pocket from which the facepieces are made may take a number of different forms within a generally tapering or generally frusto-conical section form.

The above described facepieces may each be modified to provide them with inwardly extending sealing strips for example as described in U.K. patent specification No. 2,045,093. For this purpose, a reversely frusto-conical portion 35 may be added to each end of the blank as shown in FIG. 17(*a*) (in connection with the embodiment of FIG. 15) and the end edges inwardly curved to a greater or lesser extent. After creation of the fold lines 8 to 12, the blank is folded in half and welded along its lateral edges 3, as shown in FIG. 17(*b*). The flat pocket so formed is then turned inside out as shown in FIG. 17(*c*) and the additional frusto-conical portions are folded inwards to create the inwardly directed sealing strip 36 which may extend the full way round the open mouth of the pocket or to a lesser extent, for example only in the regions of the ends of edges 3, or in the regions of the ends of edges 3 and over the nose but not under the chin, as described in the above referred to co-pending patent application.

It will be appreciated that the pocket has to be turned inside out between the stages shown in FIG. 17(*b*) and (*c*) to ensure that the sealing strip presents only a smooth surface to the face.

Figure 18:
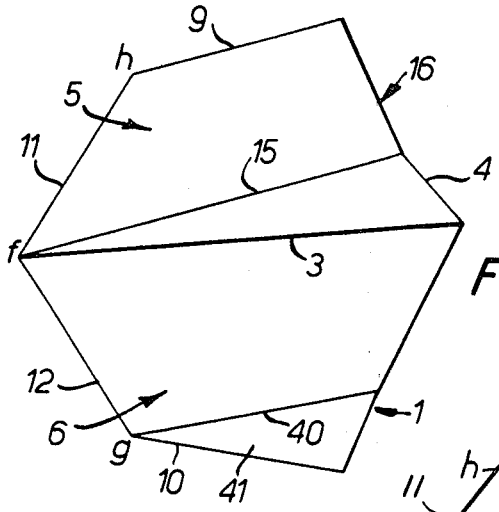
FIG. 18 is a side view of another embodiment of a filtering face piece according to the present invention in open condition.
Figure 19:
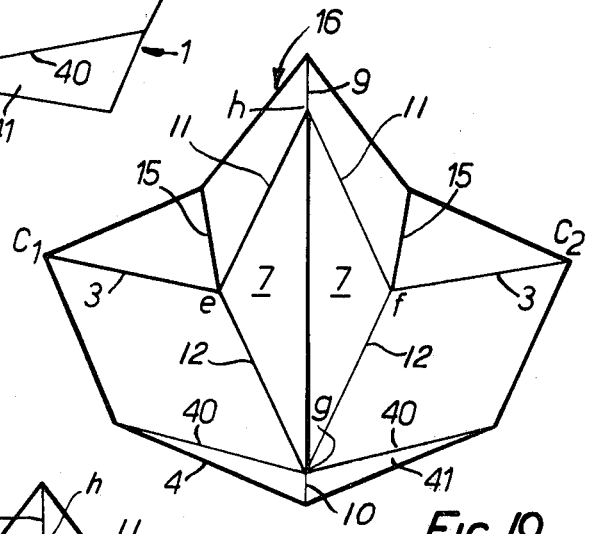
FIG. 19 is a view of the filtering face piece of FIG. 18, again in an open condition, and viewed from the open edge thereof.
Figure 26:
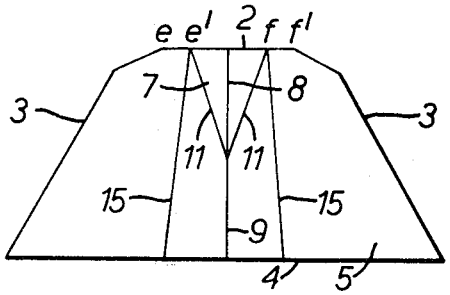
FIG. 26 is a plan view of a flat pocket used for making a further embodiment of filtering facepiece according to the present invention.

A further modification which can be applied to the filtering facepieces of FIGS. 15, 24 and 26 is shown in FIGS. 18 and 19 in relation to the embodiment of FIG. 15.

As shown, the facepiece corresponds exactly with the facepiece as shown in FIGS. 13 and 14 (and the same reference numerals have been used for like parts) except for the additional feature that, in the lower wall 6 of the facepiece, fold lines 40 are formed defining a triangular area 41 centred on fold line 10. A base of this triangular area extends along the open edge of the pocket, intermediate the lateral edges 3, and the apex opposite this base is positioned at or in the region of the apex g of the triangular areas 7.

Figure 21:
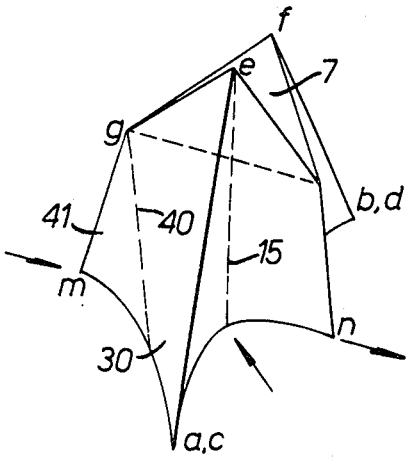
FIG. 21 shows a stage in the production of the face piece of FIG. 18.
Figure 22:
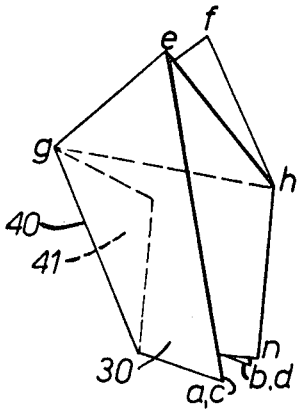
FIGS. 22 and 23 are plan views of the filtering face piece of FIG. 18 when folded flat.

As shown in FIGS. 21 and 22, the triangular area 41 is defined, and the fold lines 40 are created, at the same time as the wings 30 are folded flat. The fold lines 40 are created by pushing point m inwardly and folding the adjacent parts of the wall 7 together. This creates two half triangular areas which are folded flat against one another and have a common base along the fold line 12.

Figure 20:
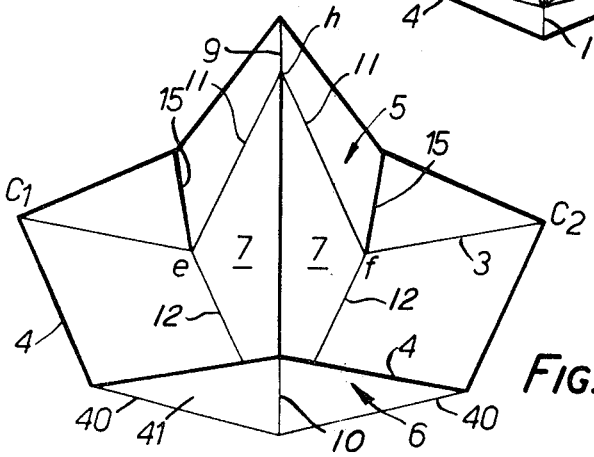
FIG. 20 is a view similar to that of FIG. 19 but during opening of the face piece.

The face piece is opened in exactly the same way as the face piece described above except that when the ends of the lateral edges 3 have been pulled apart the triangular area 41 extends across the pocket opening, as shown in FIG. 20. It is then merely necessary to pull the end of fold line 12 outwardly to flatten the triangular area 41. This area 41, when the face piece is placed on the face, underlies the chin with the fold lines 40 running generally along the edge of the lower jaw. The lower wall 7 of the face piece is thus conveniently adapted to the shape of the chin and adjacent parts of the cheeks of the wearer.

Figure 23:
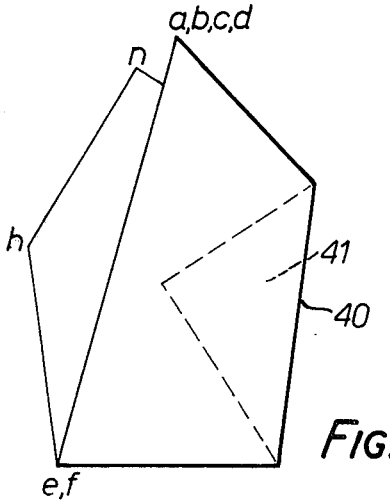

An additional advantage arising from the folding in of the triangular portion 41 is that the face piece in its flat folded condition, as shown in FIGS. 22 and 23, has a generally rectangular shape which will conveniently fit in a pocket without the need for the additional folding operations described with reference to FIGS. 10 to 12. It is pointed out that FIGS. 22 and 23 show the same face piece in a flat folded condition but in FIG. 23 the face piece is orientated for insertion in, for example, a breast pocket.

The above described face pieces may be further strengthened by the addition of further weld lines or plastics strips to the triangular surfaces 7, the further weld lines or plastics strips extending parallel to the fold line 8, or at an angle thereto, e.g. parallel to the fold lines 11 and 12.

It will be appreciated that the term 'filtering material' used hereinbefore and hereafter is used to denote a material which removes one or more unwanted components from a gas or vapour; the component may be in the form of particles and/or molecules and may be removed mechanically and/or electrostatically and/or may be absorbed and/or adsorbed by the filtering material.

What is claimed is:

1. A generally cup-shaped filtering facepiece formed of flexible filtering material adapted to cover the nose and mouth of a user, said facepiece comprising (a) convergent generally frusto-conical side wall means having at its larger end a peripheral free edge (4); and (b) end wall means (2) closing the smaller end of said side wall portion, thereby to define a pocket (1) for receiving the nose and mouth of the user with said peripheral edge extending over the nose and under the chin of the user, said end wall means including (1) a plurality of end wall panels (7) foldably connected with said side wall means by four first fold lines (11, 12) that are interconnected by four apices (e, f, g, h), respectively, said end wall panels being connected with each other by central fold line means (8) that extend between a pair of opposite apices (g, h), thereby to define between said four interconnected fold lines a quadrilateral region having two triangular panels (2) said end wall panels being folded inwardly about said four interconnected fold lines to cause said quadrilateral region to extend reversely within said pocket at the closed end of the facepiece; and (c) means (13,14) for attaching said facepiece to the wearer's head.

2. A filtering facepiece as defined in claim 1, wherein said central fold line means extends vertically.

3. A filtering facepiece as defined in claim 2, wherein said central fold line means comprises a single linear fold line (8), and further wherein said quadrilateral region comprises a pair of triangular panels (7).

4. A filtering facepiece as defined in claim 3, and further including second fold lines (9, 15) extending from the uppermost apex (h) and the adjacent two apices (e,f), respectively, toward said free edge for defining in said side wall means a first inverted V-shaped channel (16) which is adapted to seat on the nose of the user, said central fold line and that second fold line extending from the uppermost apex being contained in a common vertical plane, thereby to positively adapt said side wall means to the shape of the user's face so as to decrease edge seal leakage around the nose and in the area between the user's nose and cheeks.

5. A filtering facepiece as defined in claim 4, and further including a deformable element (31) of generally V-shaped configuration mounted to extend over the apex of said V-shaped channel, thereby to improve the seal across the bridge of the user's nose.

6. A filtering facepiece as defined in claim 4, wherein said center, first and second fold lines are longitudinally rigidified.

7. A filtering facepiece as defined in claim 6, wherein said flexible facepiece filtering material is weldable, said center, first and second fold lines being defined by welds formed in said filtering material.

8. A filtering facepiece as defined in claim 1, wherein said quadrilateral region has the configuration of a square.

9. A filtering facepiece as defined in claim 1, wherein said quadrilateral region has a kite-shaped configuration.

10. A filtering facepiece as defined in claim 1, wherein said filtering material includes microfibers having electrostatic and collision efficiency.

11. A filtering facepiece as defined in claim 1, wherein said filtering material includes activated charcoal.

12. A filtering facepiece as defined in claim 4, and further including third fold line means (12, 40) extending from the lowermost apex (g) toward said free edge for defining in said side wall means a pair of triangular panels (41) arranged to define a second inverted V-shaped channel for receiving to user's chin.

13. A filtering facepiece as defined in claim 4, wherein said side wall means includes a first frusto-conical portion of relatively large cone angle adjacent the closed end of the facepiece, and a second frusto-conical portion of relatively small cone angle adjacent the open end of the facepiece.

* * * * *